US005241929A

United States Patent [19]

Grassi et al.

[11] Patent Number: 5,241,929

[45] Date of Patent: Sep. 7, 1993

[54] ELECTRONIC ENGINE CONTROL MODULE INCORPORATING GLOW PLUG AND GLOW PLUG LAMP CONTROL

[75] Inventors: Robert P. Grassi, Hoffman Estates; Joseph R. Budimier, Oak Lawn, both of Ill.

[73] Assignee: Navistar International Transportation Corp., Chicago, Ill.

[21] Appl. No.: 932,432

[22] Filed: Aug. 19, 1992

[51] Int. Cl.[5] ..... F02P 19/02

[52] U.S. Cl. ..... 123/145 A; 123/179.6

[58] Field of Search ..... 123/179.6, 179.21, 145 A

[56] References Cited

U.S. PATENT DOCUMENTS

| | | | |
|---|---|---|---|
| 4,300,491 | 11/1981 | Hara et al. | 123/179.6 |
| 4,491,100 | 1/1985 | Yasuhara | 123/179.6 |
| 4,530,321 | 7/1985 | Caron et al. | 123/179.21 |
| 4,606,306 | 8/1986 | Caron et al. | 123/179.21 |
| 4,862,370 | 8/1989 | Arnold et al. | 123/179.6 |
| 4,939,347 | 7/1990 | Masaka et al. | 123/179.6 |
| 5,158,050 | 10/1992 | Hawkins et al. | 123/179.21 |

FOREIGN PATENT DOCUMENTS

| | | | |
|---|---|---|---|
| 59-18275 | 1/1984 | Japan | 123/145 A |
| 63-131870 | 6/1988 | Japan | 123/145 A |

*Primary Examiner*—Andrew M. Dolinar
*Attorney, Agent, or Firm*—Dennis K. Sullivan

[57] ABSTRACT

The engine control module incorporates strategy which controls and modulates glow plug activation and also controls activation of a glow plug indicator lamp mounted in the cab of the vehicle. The control functions are separate in action but both are based on first sensing input power. If power is out of a predefined range strategy is provided for maintaining the glow plugs off. Both are secondly based on sensed engine coolant temperature, with out of range coolant temperatures causing activation of the glow plugs so long as input power is within range.

6 Claims, 1 Drawing Sheet

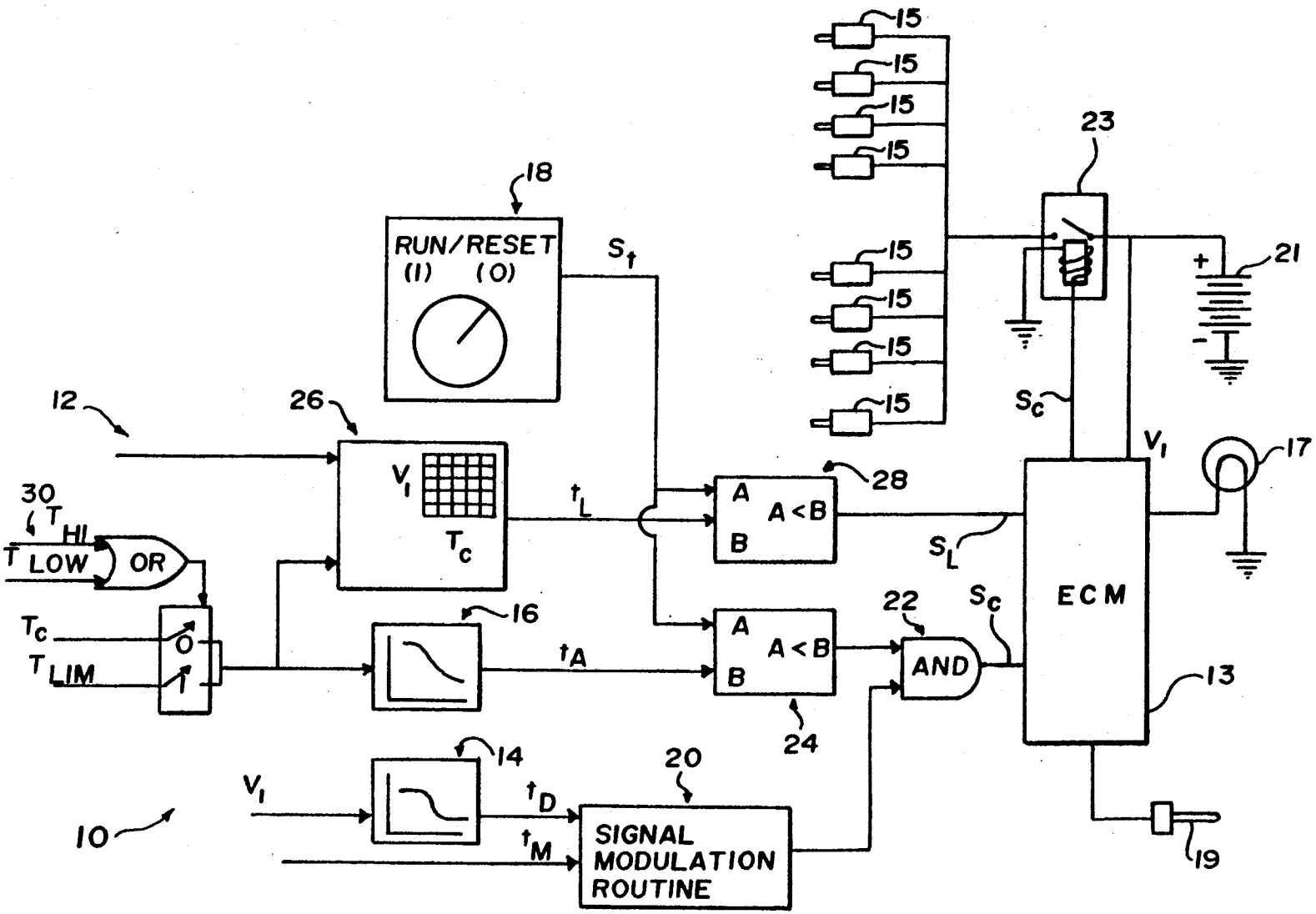
ECM
AND
A<B
A
B
RUN/RESET
(1)
(0)
SIGNAL MODULATION ROUTINE
OR
HI
LOW
LIM
10
12
13
14
15
16
17
18
19
20
21
22
23
24
26
28
30

ELECTRONIC ENGINE CONTROL MODULE INCORPORATING GLOW PLUG AND GLOW PLUG LAMP CONTROL

BACKGROUND OF THE INVENTION

The present invention relates to an engine control module for a diesel engine incorporating a glow plug control function and a glow plug indicator lamp control function therein which utilize existing sensor signals being input to the control module. The monitored operating parameters for the glow plug control function are engine coolant temperature and input battery voltage.

PRIOR ART

Heretofore, various glow plug control systems including stand-alone circuits have existed.

One previous system, described in U.S. Pat. Nos. 4,530,321 and 4,606,306, is implemented with circuitry which measures current through the glow plugs, and modulates the glow plugs above a predetermined voltage level to avoid burn-out. Such circuitry requires a good ground circuit and the presence of a feedback circuit for determining modulating parameters.

As will be described in greater detail hereinafter, the glow plug control function of the present invention comprises strategy incorporated into an electronic engine control module which utilizes coolant temperature and battery voltage as parameters for determining the need for modulated activation and requires no feedback circuit, simply utilizing sensors already used by the engine control module.

SUMMARY OF THE INVENTION

A primary object of the invention described and claimed herein is to provide a glow plug control function utilizing existing engine sensors and circuitry for determining the operation of glow plugs.

A further object of the invention is to eliminate the need for a feedback circuit.

A still further object of the invention is to eliminate the need of an absolute ground for the circuit.

A yet further object of the invention is to provide a glow plug control strategy which utilizes coolant temperature and battery voltage as the control parameters.

A still further object of the invention is to provide a glow plug control function which only allows operation of the glow plugs when input battery voltage is at or below 17.2 volts.

A yet further object of the invention is to provide a glow plug control function which has a default parameter of deenergizing the glow plugs.

A further object of the invention is to provide a glow plug control function which utilizes coolant temperature as a primary parameter for enabling the glow plugs when input battery voltage is less than 17 volts.

A still further object of the invention is to incorporate the glow plug control function within an engine control module to eliminate a stand-alone circuit.

A yet further object of the invention is to provide a control function in the engine control module which also operates a glow plug indicator lamp in a cab of the vehicle to indicate glow plug activation.

These objects and others are met by an engine control module of the present invention which incorporates a glow plug control function which polls a coolant temperature sensor and senses the input battery voltage to the electronic engine control module, deenergizing the glow plugs as its default, and only turns the glow plugs on at input voltages below 17.2 volts, or at coolant temperatures below 82° C., and further controls activation of a glow plug indicator lamp in the cab of the vehicle in a similar manner.

BRIEF DESCRIPTION OF THE DRAWING

The drawing schematic diagram of an engine control module and related apparatus for controlling the glow plugs and the glow plug indicator lamp of the present invention.

DESCRIPTION OF THE PREFERRED EMBODIMENT

Referring now to FIG. 1 in greater detail, there is illustrated therein a schematic representation of an engine control module 13 having the glow plug control and glow plug indicator lamp functions of the present invention generally identified by reference numerals 10 and 12, respectively, which although shown external of the engine control module 13 for purposes of illustration, are in fact programmed functions of the engine control module.

The glow plug control function 10 and glow plug lamp control function 12 are incorporated into an electronic engine control microprocessor or module 13 and the method of control incorporates two separate strategies. The first strategy deals with control of the operation of the glow plugs 15 and the second deals with control of a glow plug indicator lamp 17 on the instrument panel (not shown) of the vehicle. Operation of the glow plug indicator lamp alerts the vehicle driver to wait before cranking over the engine and operation thereof, according to the strategies to be defined hereinafter, is totally independent of operation of the glow plugs.

The glow plug control function 10 includes generation of a glow plug control signal identified as $S_C$ which is controlled by setting and clearing of a flag, a bit of logic comprising an electrical pulse.

Likewise the glow plug indicator lamp control function 12 strategy includes a generated signal identified as $S_L$ which is controlled by setting and clearing of a similar flag.

Both flags have only two possible logic values, a 1 indicating an "on" condition and a 0 indicating an "off" condition. Thus, when either flag has a logic value of 1, the corresponding signal is generated and when the flag has a logic value of 0, the signal ceases.

The signals differ from one another in that lamp signal, $S_L$, is constant during a period of glow plug activation while the glow plug control signal, $S_C$, is modulated during the period of glow plug activation, to repeatedly turn the glow plugs on and off intermittently during the activation period. Such modulation of glow plug activation increases the life of the glow plugs while continuing to warm the engine during start up.

Operation of both strategies is dependent upon two input parameters, one being engine coolant temperature ($T_C$) and the other being battery voltage ($V_I$), and the control strategy can be activated in the no-start, crank and run modes of engine operation. In the no-start mode, the engine is not operating but power is being supplied to the system and the glow plugs are activated to bring them up to temperature and also to warm the cylinders for easing starting of the engine, especially if the ambient environment is cold. In the crank mode of operation, one is attempting to start the engine and the glow plugs are energized to warm the cylinders to begin engine operation. In the run mode of operation, the glow plugs are maintained activated after engine start-up to warm the engine more quickly until the engine is sufficiently warm to significantly decrease, if not altogether eliminate, production of white smoke.

It will be understood that the control strategies are incorporated in the engine control module of a vehicle engine, using sensors thereof for input of values for the two parameters to be monitored, thereby eliminating the need for separate glow plug control or glow plug indicator lamp circuits. In this respect, an engine coolant temperature sensor 19 is monitored as $T_C$ by the electronic engine control module 13, as is input voltage $V_I$ from the vehicle battery and charging system 21. Thus, no additional sensor signals are necessary beyond those already input to the electronic engine control module 13.

The electronic engine control module 13, however, cannot supply power to the glow plugs 15 for operation because the current demand of the glow plugs is too high for the module to accommodate. Therefore, the glow plugs 15 receive power directly from the vehicle battery 21 through a relay 23 in the power line from the battery to the glow plugs. The electronic engine control module 13, through the glow plug control function 10, uses the $S_C$ signal to control the relay 23, causes intermittent activation of the glow plugs 15, and determines a time interval over which such modulated activation takes place, based on sensed engine coolant temperature $T_C$.Thus, when the signal $S_C$ is present, the relay 23 closes, turning the glow plugs on. Conversely, when the $S_C$ signal ceases, the relay opens and turns off the glow plugs.

When the control functions 10 and 12 are placed into operation by activation of the engine ignition which causes provision of electrical power to all engine circuits, reset of the engine control module 13 occurs, resetting a timer 18 internal to the engine control module which generates a signal $S_t$ indicative of time elapsed since engine ignition activation. This reset is programmed to produce a necessary delay for the system to stabilize before energizing the glow plugs, one second in the particular embodiment disclosed, the duration of the delay being defined by a calibration constant $C_D$, which is determined for the engine and glow plug combination through empirical testing.

Once the delay period has expired and, if the engine coolant temperature $T_C$ and input voltage $V_I$ are found to be within range, the signal $S_C$ is present and the glow plugs are activated. Once activated, the glow plugs are turned on and off in regular cycles by the $S_C$ signal. The $S_C$ signal is a pulse-width-modulated signal having a duty cycle controlled by the glow plug control function 10 which turns signal $S_C$ on and off at regular intervals, as described above.

The constant $C_D$ also defines the length of the modulation period $t_M$, i.e., the length, in seconds, of one complete "glow plugs on"/ "glow plugs off" cycle. The percentage of time that the glow plugs are on during one modulation period is specified by the duty cycle $t_D$. $t_D$ is determined as a function of battery voltage, $V_I$.In cases where battery voltage is low, $t_D$ approaches 100 percent and the glow plugs may be on, without modulating, for the entire activation period $t_A$, i.e., the total elapsed activation time of the glow plugs since reset of the engine control module.

In this respect, it will be understood that the glow plug activation is pulse-width-modulated to avoid plug burnout. However, the duty cycle $t_D$ can approach a constant "on" condition when voltage is significantly decreased because the glow plugs do not heat up as much at low voltages, and can be maintained "on" for longer periods of time without burnout. The value for $t_D$ is generated from a lookup table 14 in the memory of the engine control module 13. Once the desired duty cycle time $t_D$ has been determined, this signal is used in combination with the modulation period $t_M$ produced by constant $C_D$ to produce a signal modulation routine at 20 to modulate glow plug activation.

Additionally, the maximum input voltage $V_I$ for glow plug activation is set to 17.2 volts. If the glow plugs were to turn on above this voltage, they could be destroyed. Thus, the lookup table 14 also provides a default for the glow plug control function 10 to maintain the glow plugs off at higher voltages.

Simultaneously, engine coolant temperature $T_C$ is sensed by engine coolant temperature sensor 19 to permit the glow plug control function 10 to calculate the desired total glow plug activation time $t_A$. If the sensed temperature is below a desired limit $T_{LIM}$, 82° C. in this embodiment, a lookup table 16 in the memory of the engine control module 13 provides the desired activation time period for a corresponding coolant temperature. If the sensed temperature is above the desired level, the glow plugs 14 are maintained off by the default for the strategy. The activation period value $t_A$ calculated is indicative of total required glow plug activation time and is constantly compared to the elapsed time on $S_t$ and, when the elapsed time reaches the value of required time $t_A$ glow plugs turn off until a key reset takes place. If the timer signal $S_t$ is less than the desired activation signal $t_A$, the activation signal is supplied along with the signal from the signal modulation routine logic 20 to an AND gate 22 and, so long as elapsed time of activation is below the calculated activation time as determined at comparator 24, the $S_C$ signal is continuously cycled on and off, turning the glow plugs 15 on and off, until the timer 18 reaches the total time calculated for glow plug activation, $t_A$, based on engine coolant temperature. At that time, the signal $S_C$ ceases and the glow plugs are turned off. They remain off until the next time the electronic control module resets upon activation of the engine ignition.

The control function 12 for the glow plug indicator lamp 17, is used to advise the vehicle operator to wait for a specified period of time before cranking the engine. This time is required to allow the cylinders to warm up. The lamp function 12 is entirely separate from the control function 10 for the glow plugs 15, but is also dependent on engine coolant temperature $T_C$ and input voltage $V_I$. Here, input voltage $V_I$ is plotted relative to coolant temperature $T_C$ in a lookup table 26 in the memory of the engine control module 13, and a specific desired time interval of lamp activation $t_L$ is calculated. The range of $t_L$ is 1 to 300 seconds, so there is always a minimum of one second of lamp activation time after the electronic control module resets. The desired lamp activation duration $t_L$ is output to a comparator 28 which compares it to the $S_t$ reading from the timer 18. As long as the desired activation time exceeds time since reset, the lamp signal $S_L$ is generated. Because the glow plug lamp 17 requires less power than the glow plugs, the lamp signal $S_L$ may be used to activate the lamp directly. When the timer $S_t$ counts to the number of seconds specified by the desired duration $t_L$ of lamp activation, the glow plug indicator lamp 17 is turned off.

Simplifying, when the glow plug control function 10 is first activated, the input battery voltage $V_I$ is sensed and, if below 17.2 volts, the lookup table 14 issues a duty cycle signal $t_D$, for glow plug activation based on the sensed input voltage $V_I$ The duty cycle signal, $t_D$, is then combined with the modulation period signal $t_M$ to modulate the signal. After the initial activation, the sensed voltage $V_I$ is continuously updated to produce an appropriate duty cycle signal $t_D$.

Simultaneously, engine coolant temperature $T_C$ is sensed. If the sensed temperature is below a desired level, a predetermined activation period $t_A$ is determined from lookup table 16. As long as $t_A$ is greater than the elapsed time on $S_t$, the activation period signal $t_A$ is combined with the signal from the modulation routine 20 to appropriately cause cycling of the glow plug control signal $S_C$ and the relay it feeds, causing modulated glow plug operation over the predetermined time period.

Similarly, input voltage and engine coolant temperature are sensed for activation of the glow plug indicator lamp in the cab. An operating time is determined from the lookup table 26 and the lamp is lit. When this time value is equal to the value of the time period on the timer $S_t$, the lamp is turned off.

Inasmuch as the control functions 10 and 12 are sensor dependent for their operation, default values must be set for the parameters in case sensor failure occurs, primarily to protect the glow plugs. In this respect, if a failure of the input voltage supply occurred, and the glow plugs were allowed to turn on at an excessive voltage, the glow plugs would immediately burn out. Thus, a default setting of "plugs off" is programmed into the glow plug control function 10 to eliminate such possibility.

If the temperature sensor should fail, while the input voltage $V_I$ is in its normal range, a default routine 30 sets the plugs on and the electronic engine control module further causes the output of a maximum amount of fuel to accommodate a cold start.

If the temperature sensor falls out of a range between $T_{HI}$ and $T_{LOW}$, the default parameter $T_{LIM}$ will still provide a signal to turn the glow plugs on so long as the Voltage $V_I$ is within range. Thus, even if the sensor fails, the engine will start.

Inasmuch as a specific period of glow plug activation, as well as a comparable period of glow plug indicator lamp activation, is required for each activation, based primarily on sensed engine coolant temperature, a comparison is constantly made between elapsed time on the internal timer 18 and the specified periods of activation, $t_L$ and $t_A$. Once the timer 18 signal $S_t$ equals each specified period, the glow plugs and/or the glow plug indicator lamp are disabled and remain so until the engine ignition is turned on and timer 18 is reset.

With respect to default settings for the lamp control function 12, it will be understood that the lamp is activated immediately upon engine ignition activation. The range of activation extends from 1 to 300 seconds, so there is always at least a one second activation at each start-up.

As described above, the electronic engine control module 13 incorporating the glow plug and glow plug lamp control functions 10 and 12 has a number of advantages, some of which have been described above and others of which are inherent in the invention. It will be apparent to those of ordinary skill in the art that various modifications, alterations and additions may be made to the engine control module and the glow plug and glow plug lamp control functions thereof without departing from the teachings herein. Accordingly, the scope of the invention is only to be limited as required by the accompanying claims.

What is claimed is:

1. A method of controlling glow plug activation by means of strategy incorporated into an electronic control module of a key activated engine, said electronic control module being operatively engaged to at least an engine coolant temperature sensor, a sensed battery voltage, and a relay in a power line from the vehicle battery to the glow plugs, said method comprising the steps of:

resetting to zero an internal timer at key activation and continuously clocking time elapsed since engine key activation;

sensing battery voltage;

comparing sensed battery voltage with a range of voltages stored in a memory of the electronic control module and, if within range, continuing with the method; or, if the sensed battery voltage is out of range: maintaining the glow plugs deenergized;

calculating a duty cycle for glow plug activation during the activation period based on the voltage sensed;

sensing engine coolant temperature;

comparing sensed coolant temperature with a range of coolant temperatures stored in the engine control module; and calculating a time period for glow plug activation if sensed temperature falls within range;

inputting a constant value for the particular engine defining the desired glow plug modulation period; and generating a signal to a glow plug energizing relay based on the above parameters to cause glow plug activation.

2. The method of claim 1 further including the steps of determining if the engine coolant temperature sensor is functional and, if not, generating a default status activation signal which activates the glow plugs.

3. The method of claim 1 further including the steps of:

determining total time elapsed since engine key activation;

comparing the total time elapsed to determined time of glow plug activation; and, if total time elapsed exceeds determined time, turning the glow plugs off.

4. A glow plug control apparatus incorporated into an electronic control module of an engine for modulated control of activation of glow plugs of the engine and control of a glow plug indicator lamp situated in a driver compartment of a vehicle incorporating the engine, said control comprising strategy for monitoring the parameters of engine coolant temperature and input electrical power from batteries of the vehicle and, based on predetermined control values for these parameters stored in a memory module of the engine control module, causing activation of said glow plug indicator lamp and modulated activation of said glow plugs as said strategy dictates, said control apparatus including:.

an internal timer which resets at key activation and continuously clocks time elapsed since engine key activation;

means for sensing battery voltage;

means for comparing sensed battery voltage with a range of voltages stored in a memory of the electronic control module and if within range, supplying an output signal; or, if the sensed battery voltage is out of range, preventing an output signal, thereby maintaining the glow plugs deenergized;

means for calculating a duty cycle for glow plug activation during the activation period based on the voltage sensed;

means for sensing engine coolant temperature;

means for comparing sensed coolant temperature with a range of coolant temperatures stored in the engine control module and providing a coolant temperature output signal if sensed coolant temperature falls within range;

means responsive to said coolant temperature output signal for calculating a time period for glow plug activation if sensed temperature falls within range;

means for inputting a constant value for the particular engine defining the desired glow plug modulation period; and means responsive to said glow plug activation time period and said desired glow plug modulation period constant value for generating a signal to a glow plug energizing relay to cause glow plug activation.

5. The control apparatus of claim 4 further including means for sensing a malfunction in said sensed voltage and means preventing said output signal for maintaining said glow plugs off if such malfunction is sensed.

6. The control apparatus of claim 4 further including means for sensing malfunction in said coolant temperature sensor and means providing said coolant temperature output signal for a predefined time period, thereby causing said glow plugs to turn on, if such malfunction is sensed.

* * * * *